US005768819A

United States Patent [19]

Neal

[11] Patent Number: 5,768,819

[45] Date of Patent: Jun. 23, 1998

[54] GUN GUARD

[75] Inventor: Kim W. Neal, Dayton, Ohio

[73] Assignee: GBG Corporation, Dayton, Ohio

[21] Appl. No.: 818,177

[22] Filed: Mar. 14, 1997

Related U.S. Application Data

[60] Provisional application No. 60/013,392 Mar. 14, 1996.

[51] Int. Cl.[6] ..... F41A 35/04

[52] U.S. Cl. ..... 42/96; 42/70.07; 42/70.11

[58] Field of Search ..... 42/96, 70.07, 70.11

[56] References Cited

U.S. PATENT DOCUMENTS

| | | | |
|---|---|---|---|
| 835,349 | 11/1906 | Deming | 42/70.08 |
| 1,513,267 | 10/1924 | Parks | 42/70.11 |
| 1,930,203 | 10/1933 | Jewett | 224/2 |
| 2,364,340 | 12/1944 | Bogg, Jr. | 42/1 |
| 2,932,334 | 4/1960 | Steen | 150/52 |
| 3,616,559 | 11/1971 | Sobolewski | 42/1 |
| 4,030,221 | 6/1977 | Doobenen et al. | 42/1 Y |
| 4,084,341 | 4/1978 | Cervantes | 42/1 Y |
| 4,122,620 | 10/1978 | Alexander | 42/1 LP |
| 4,286,741 | 9/1981 | Rogers | 224/193 |
| 4,509,281 | 4/1985 | Dreiling et al. | 42/1 Y |
| 4,689,908 | 9/1987 | McClellan | 42/71.02 |
| 4,912,867 | 4/1990 | Dukes, Jr. | 42/70.11 |
| 5,138,786 | 8/1992 | Fischer | 42/70.11 |
| 5,191,158 | 3/1993 | Fuller et al. | 42/70.07 |
| 5,309,661 | 5/1994 | Fuller et al. | 42/70.07 |
| 5,313,733 | 5/1994 | Meade | 42/70.11 |
| 5,450,684 | 9/1995 | Harris | 42/70.07 |
| 5,515,633 | 5/1996 | Harris | 42/70.07 |

*Primary Examiner*—Charles T. Jordan
*Assistant Examiner*—Meena Chelliah
*Attorney, Agent, or Firm*—Biebel & French

[57] ABSTRACT

A gun lock-out safety device comprises a generally clamshell enclosure and a cylinder key lock. The clamshell enclosure includes two half-shells formed from durable, impact-resistant material, and are sized and shaped to closely fit the contours of the gun to be secured. The half-shells are hingedly connected to form the clamshell enclosure and have marginally interlocking edges to further resist prying and tampering. When properly used, the gun lock-out safety device covers a major portion of the gun including a trigger, trigger guard, breech and/or hammer, and guards against accidental discharge or unauthorized use of the gun.

5 Claims, 3 Drawing Sheets

GUN GUARD

This application claims the benefit of U.S. provisional application Ser. No. 60/013,392, filed Mar. 14, 1996.

BACKGROUND OF THE INVENTION

1. Field of the Invention

This invention relates to gun lock-out safety devices for use with firearms, and more particularly, it relates to a gun guard having a generally clamshell structure that encloses a major portion of a firearm, including a trigger and trigger guard.

2. Background of the Invention

Problems of gun safety are well known and there has long been a need to prevent accidental discharges or unauthorized uses of firearms. Accidents particularly involving children and guns are too common. Guns by their nature are attractive to children. To remedy these problems, many various locking devices and mechanisms have been developed to prevent unauthorized or accidental operation of firearms.

One solution to the problem of gun safety is a trigger lock. One disadvantage of most trigger locks is that they leave a major portion of the gun, if not all of the gun, exposed and unprotected. Also, trigger lock devices can be defeated. Further, conventional trigger locks permit the gun to be tampered with, even loaded or unloaded.

Another approach involves a device which fits into the magazine of firearms which employ box-type magazines. However, this type of device also leaves a major portion of the firearm exposed, allowing the firearm to be loaded and fired in a single-shot fashion.

Other approaches to gun safety have involved devices that are integral with the gun itself. These devices often involve blocking some portion of the firing mechanism, such as a bolt, hammer, or safety, against movement. However, these devices require incorporation into the gun at the time of manufacture, or require installation by a gunsmith. These devices may increase the cost of the firearm, may interfere with the proper operation of the firearm, or may malfunction and fail.

The prior art presents locking mechanisms that may be jammed or interfered with and thus, are unreliable. Others are complex or difficult to install or use, either when the firearm is manufactured or as a retrofit to existing firearms. Others do not enclose major portions of the firearm, and do not prevent tampering with or disassembly of the firearm. Therefore, there is a need for a gun lock-out safety device that is simple, effective, easy to use, encloses a major portion of the gun, and prevents accidental discharge or use of the gun by unauthorized users.

SUMMARY OF THE INVENTION

These disadvantages, and others, are met by means of the present invention embodied in a clamshell enclosure. The present invention totally encloses a major portion of the working mechanism of a handgun, including the trigger and, in the case of a pistol, including the loading mechanism, the hammer, and the breech. Thus enclosed, there is little left in the appearance of the gun to attract a youngster to try to play with the gun and the enclosing clamshell cover is highly resistant to attempts to defeat it.

The gun guard is a clamshell cover comprising a first half-shell and a second half-shell, hingedly connected to form a clamshell enclosure. The gun guard may have one or more hinges disposed along the edges of the half-shells adjacent to the gun barrel or receiver, opposite the trigger. Preferably, the hinges have permanent pins.

The clamshell enclosure is formed with mutually interlocking marginal edges which are held in closed relation by a lock mechanism and resists entry or prying apart. The lock mechanism may be positioned in front of the trigger or even the trigger guard, or in appropriate instances, behind the trigger for positive protection.

The clamshell enclosure can be made with any suitable durable high-impact material and may be provided with a surface coloration or design as desired. While the clamshell cover conforms generally to the shape of the gun, one enclosing cover could be made to protect and secure more than one gun model. However, the encasing protector should fit closely around the handgrip, in the case of a handgun, to prevent access to the trigger. The clamshell enclosure may be fitted with rubber pads along its interior surfaces to protect the gun and assure positive contact between the enclosure and the gun.

When placed about a gun, the gun guard completely encloses and protects a major portion of the gun's mechanism. Also, the gun is protected from dirt, and the mechanism is protected in case the gun is dropped.

The gun guard could be sold with the gun, when new, or it could be provided as an after-market safety accessory.

The invention therefore may be characterized as a safety gun shield for enclosing the operable portions of a handgun or the like, while protecting the operable portions and preventing unauthorized access, in which a pair of mutually engageable left-hand and right-hand body parts, of substantially identical configuration to each other (i.e. one is a mirror image of the other), and each forms a partial recess. One or more hinges permanently connect each of the parts together along a common margin or line which is oriented substantially parallel to the gun barrel when the gun is installed. The individual clamshell parts are movable between a closed position in which an interior space is proportioned to receive a handgun therein, and an open position, as shown by the phantom view of one of the parts in FIGS. 3 and 5. When the gun is inserted, all of the gun breech, the trigger, the trigger guard, and a portion of the barrel and a portion of the handle are received within the safety gun shield of this invention.

The parts, in the closed position, define a forward facing opening which is proportioned to permit the gun barrel to extend therethrough and a bottom facing opening which is proportioned to permit a portion of the gun handle to extend therethrough, and when moved to the closed position, only a small part of the gun barrel and the gun handle extends through their respective openings.

The clamshell construction has mutual interfitting and overlapping edge portions for resisting ingress of a tool therebetween. The hinges, along the common margin, have wings that are substantially embedded within the material particularly where the guard is made of a molded plastic material, which is preferred.

Therefore, it is one object of the invention to provide a gun guard that is simple to use and reliably prevents tampering with or accidental discharge of a gun. This and other objects, features, and advantages of the present invention will be described in further detail in connection with preferred embodiments of the invention shown in the accompanying drawings, wherein:

DETAILED DESCRIPTION OF THE PREFERRED EMBODIMENT

FIGS. 1–5 illustrate a preferred embodiment of a gun guard or shield for enclosing a major portion of a handgun, including a trigger, trigger guard, and hammer. The outline of such a handgun 11 is represented by the broken lines in FIG. 1 with a gun barrel 11A and a handgrip 11B.

Figure 1:
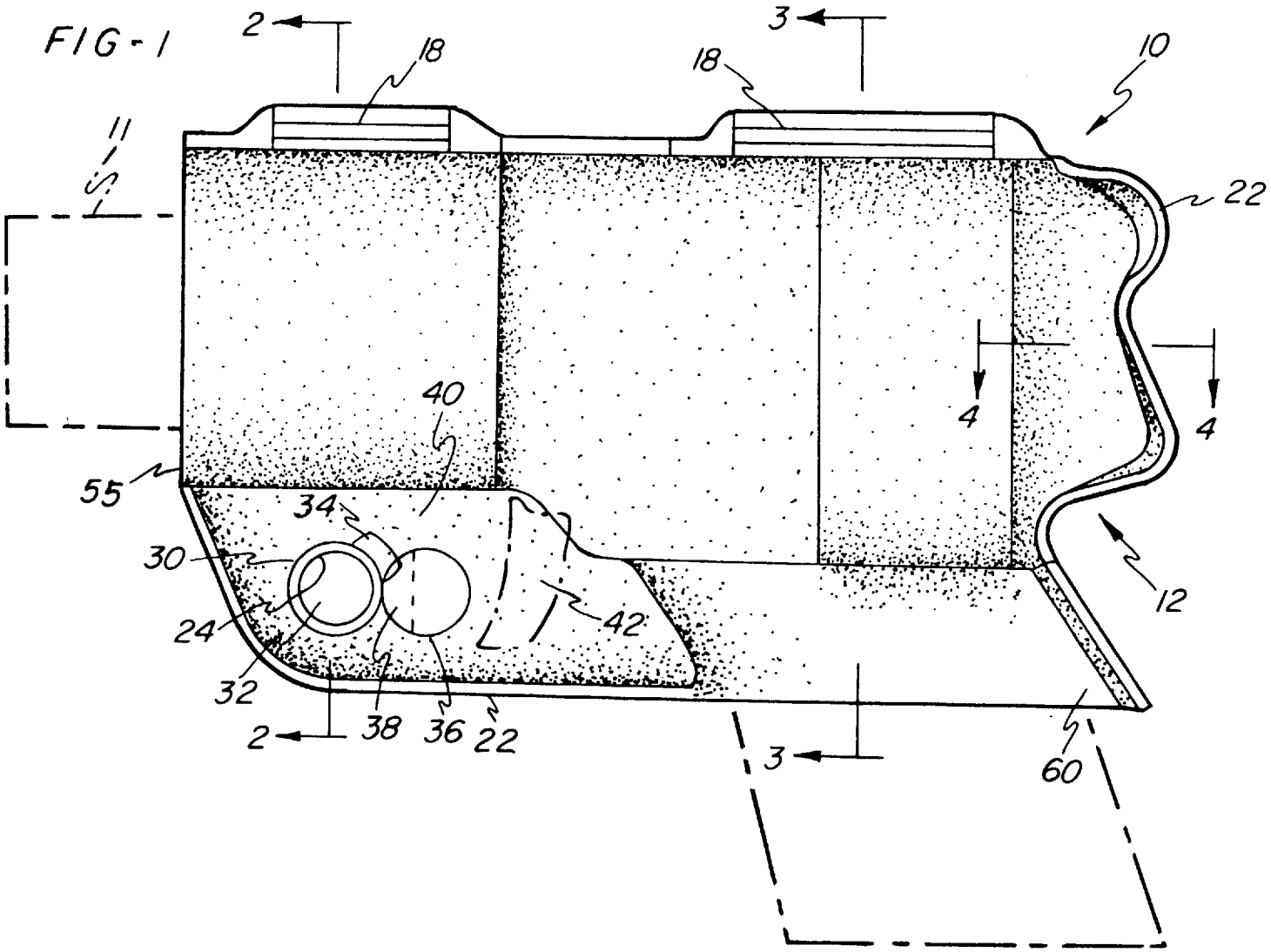
FIG. 1 is a side view of the gun guard body part with one other body part removed.
Figure 3:
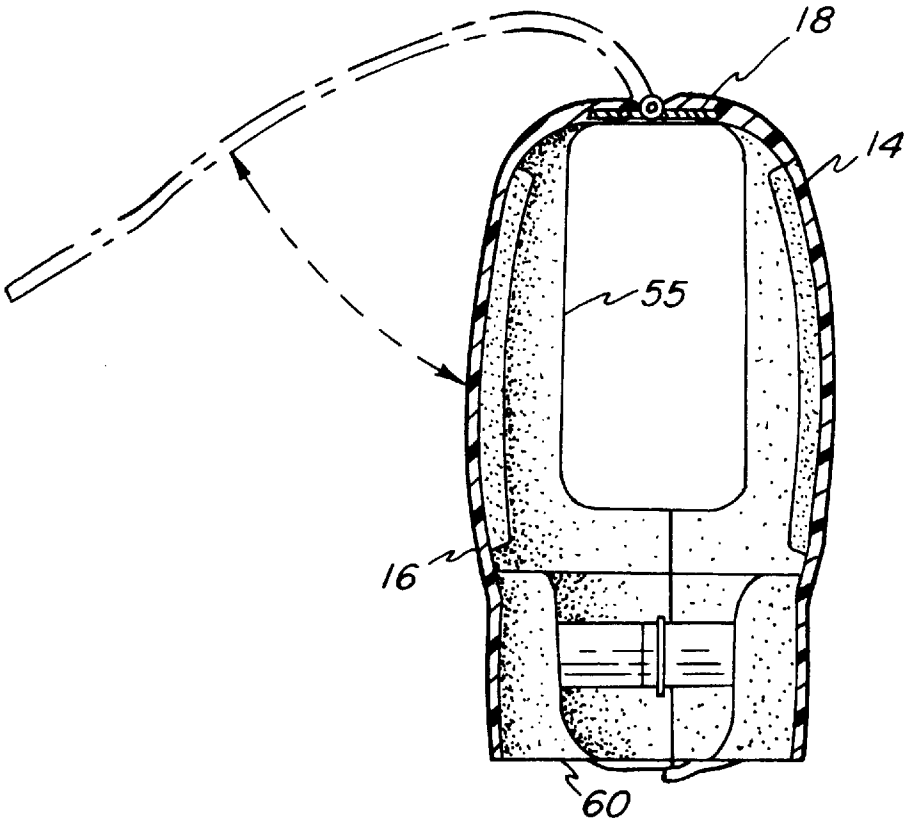
FIG. 3 is a cross-sectional view of the gun guard taken along the line 3—3 in FIG. 1.
Figure 2:
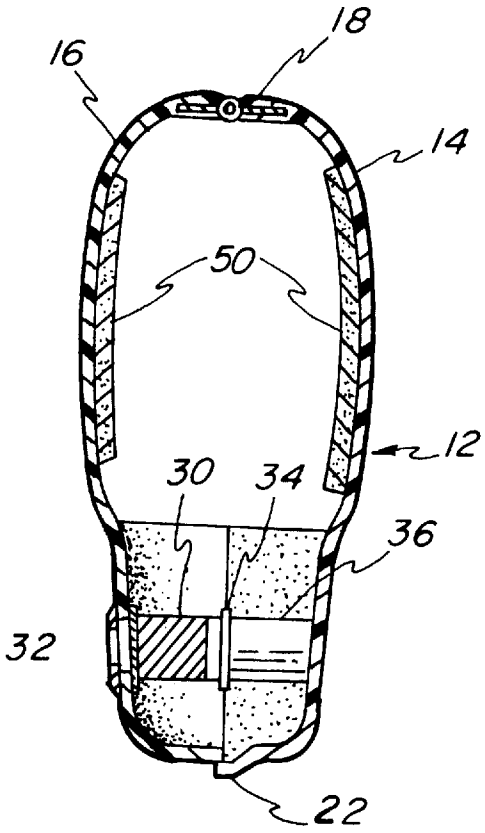
FIG. 2 is a cross-sectional view of the gun guard taken along the line 2—2 in FIG. 1.

As can be seen in FIGS. 1 and 2, the gun guard 10 is generally a clamshell enclosure 12, comprising a first body part or half-shell 14 and a second body part or half-shell 16. The half-shells 14, 16 are shaped to form a recess and closely fit the contours of a firearm to be protected. The parts 14, 16 may be formed, cast, machined, stamped, or molded out of any durable, impact-resistant material such as polycarbonate, fiberglass, polypropylene, polyethylene, or steel. The foregoing list is not exhaustive and is not intended to limit the possible materials that may be used.

Figure 5:
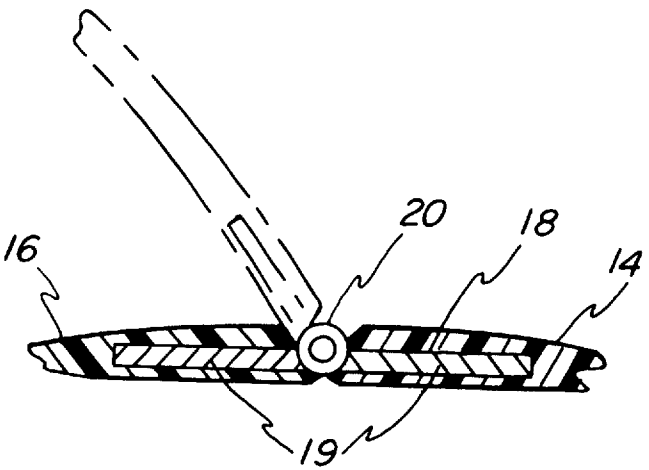
FIG. 5 is an enlarged view of the gun guard hinge portion.

Referring to FIGS. 1, 2, 3, and 5, the half-shells 14, 16 are hingedly connected along mating edges to each other to form the clamshell enclosure 12 by one or more hinges 18. As shown in FIG. 5, the wings 19 of the hinges 18 are embedded within the half-shells 14, 16 or may be attached thereto by any suitably permanent means, and preferably have permanent enclosed hinge pins 20, so as to resist tampering. The hinges 18 are preferably located along edges of half-shells 14, 16 such that when clamshell enclosure 12 is encasing the firearm, the hinges 18 are disposed adjacent to the barrel or receiver of the firearm, opposite the trigger with the pins 20 parallel to the gun barrel 11A. However, hinges 18 may be disposed along any edge which permits the gun guard 10 to be enclosed about the firearm. When the clamshell enclosure 12 is closed, the edges of half-shells 14, 16 adjacent hinges 18 abut each other in close relationship to prevent the insertion of prying devices between the half-shells 14, 16.

Figure 4:
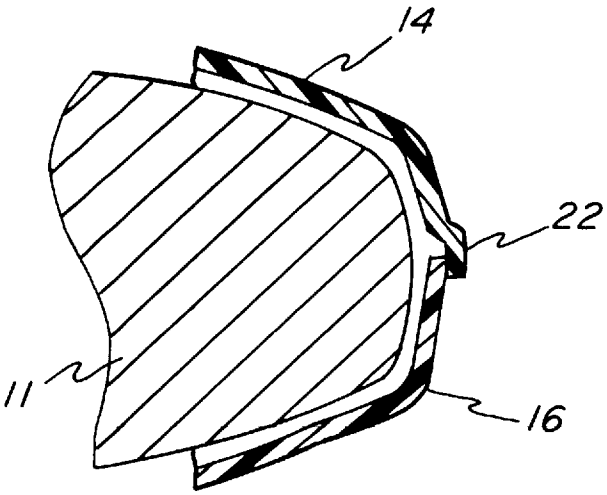
FIG. 4 is a cross-sectional view of the gun guard taken along the line 4—4 in FIG. 1.

In FIGS. 1, 2, and 4, it can be seen that first half-shell 14 is formed with a flanged overlap or lip 22 along portions of its peripheral edge so as to overlap conforming portions of the peripheral edge of second half-shell 16 in marginal interlocking relationship when the gun guard 10 is in a closed position. Alternatively, lip 22 could be formed on second half-shell 16, or both half-shells 14, 16 could have lips 22 disposed in cooperative relationship. The marginally interlocked edges provide greater resistance to tampering and ensure positive enclosure of the firearm 11 to be protected (partially shown in phantom form in FIG. 1).

Referring to FIGS. 1 and 2, secured to second half-shell 16 is a cylindrical key lock 30. Second half-shell 16 includes a hole 24 of sufficient diameter to receive cylindrical key lock 30. Key lock 30 is positioned in half-shell 16 such that the key lock face 32 lies substantially flush with the surface of second half-shell 16 and the key lock 30 long axis is oriented substantially perpendicularly to the surface of second half-shell 16. Key lock 30 is positioned in half-shell 16 near an edge opposite hinges 18 such that when the gun guard 10 is in closed position about a firearm, the key lock 30 extends into a region 40 defined by the firearm trigger 42 (shown in phantom relief in FIG. 1) and a trigger guard (not shown) and may extend inside or outside of the trigger guard. Attached to the end of key lock 30 projecting into the region 40 is a flange 34. Flange 34 lies substantially in a plane perpendicular to the long axis of key lock 30 and extends laterally therefrom.

Secured to first half-shell 14 is a lock catch 36. Lock catch 36 is positioned in first body part or half-shell 14 along an edge opposite hinges 18 and projects substantially perpendicularly from an interior surface of first half-shell 14 into the region 40. Lock catch 36 is preferably made of hardened steel and has a notch 38, in the end projecting into region 40, designed to receive flange 34 when the clamshell enclosure 12 is in a closed position and the key lock 30 is in a locked position. Although the key lock 30 and key latch 36 are shown as being positioned in front of trigger 42 (FIG. 1), they may alternatively be located so as to be positioned behind trigger 42, in an appropriate case, to positively prevent trigger 42 from being actuated rearward or may be positioned forward of the trigger guard (not shown). Although key lock 30 and lock catch 36 are secured to half-shells 16 and 14, respectively, in the preferred embodiment, they could alternatively be secured to half-shells 14 and 16, respectively.

Referring to FIG. 2, a plurality of cushioning pads 50 may be attached to the interior surfaces of half-shells 14, 16. The cushioning pads 50 protect the surface of the gun to be secured and ensure positive engagement of the gun guard 10 with the gun. The number and placement of cushioning pads 50 are determined by the contours of the particular gun to be secured and the degree of protection and positive engagement sought to be achieved. The cushioning pads 50 preferably are made of foam rubber, but any suitable cushioning material may be used.

One method for fabricating the gun guard 10 includes the steps of positioning the hinges 18 and lock catch 36 in the proper positions within a set of molds. Suitable impact-resistant material, such as polycarbonate, is then flowed into the molds so as to form two half-shells 14, 16 approximately 2.0 mm in thickness, with the hinges 18 and lock catch 36 embedded within the material forming the half-shells 14, 16. When the material is suitably cured, a hole 24 of sufficient diameter to receive cylinder key lock 30 is formed in half-shell 16. Key lock 30 is inserted into the hole and secured to the half-shell 16. Rubber cushioning pads 50 may then be secured to the interior surfaces of the half-shells so as to protect a firearm and provide for positive engagement of the gun guard 10 with the firearm to be protected.

In operation, the gun guard 10 is positioned about a firearm 11 to be protected. The half-shells 14, 16 are rotated toward each other about hinges 18 to a closed position, thereby engaging lip portions 22 of half-shell 14 with corresponding edge portions of half-shell 16. A key (not shown) is inserted into key lock 30 and rotated to engage flange 34 with notch 38 of lock catch 36. The gun guard 10 is now secured about the firearm, thereby preventing unauthorized use of and tampering with the firearm.

The gun guard 10 is an encasement in which the firearm rests to prevent unauthorized use. Each gun guard 10 includes a uniquely keyed key lock 30 to prevent the gun guard 10 from being operated by any key except the key matched to the key lock 30. Rubber cushioning pads 50 on the inside of the gun guard 10 prevent the firearm from being damaged in any way.

The gun guard 10 can be made for any type of firearm. While the embodiments described show gun guards made for automatic and revolver handguns, gun guards may also be made to secure the breeches and firing mechanisms of rifles, shotguns, and machine guns, and are not intended to be limited to the firearms described herein. The gun guard 10 can be made to fit the intended firearm like a glove so as to prevent any opening for unauthorized use. Moreover, there is no need to force the gun guard 10 into position about the firearm to be secured. The overlapping edges of the gun guard 10 further resist efforts to tamper with or use the firearm.

The gun guard 10 is approximately 2.0 mm thick and its size will depend on the weapon it is customized to fit. The thickness of the gun guard 10 may be varied as necessary to accommodate the type of material from which it is made, or to achieve a desired degree of strength and resistance to tampering. The gun guard 10 is relatively light in weight and can be conveniently carried wherever the firearm owner goes. When properly used, the gun guard 10 protects unauthorized users, especially children, from their own curiosity by eliminating their ability to fire the weapon and by making the gun far less attractive to play with.

As previously stated, the gun guard of this invention has particular utility for handguns, and a relatively small number of sizes of the guard can be advantageously adapted for encasing a plurality of somewhat different sized models of handguns. The free space can be easily filled by the selective use of an elastomer padding or cushion 50 so that the guard, when the clamshell body parts are closed, grips the side of the gun and resists movement between the shell or guard and the gun. Since the barrel of the gun extends through an forwardly facing opening 55 formed at the front of the guard while the handle extends through a downwardly facing opening 16 formed in the bottom of the guard, each opening being defined respectively by the mating together of the two halves of the body. Since the gun barrel and handle extend through these respective openings the common variations in the length of the handle and/or barrel does not adversely affect the considerations of the design of the guard itself, and therefore variations in the length of the barrel and/or the length of the handle may be readily accommodated by the use of a single guard design.

Various changes or modifications in the invention described may occur to those skilled in the art without departing from the true spirit or scope of the invention. The above description of a preferred embodiment of the invention is intended to be illustrative and not limiting, and it is not intended that the invention be restricted thereto.

I claim:

1. A safety gun shield for enclosing certain operable portions of a handgun having a barrel, a trigger and trigger guard, a breech and a hand grip while protecting said operable portions and preventing unauthorized access thereto, comprising a pair of mutually engageable left-hand and right-hand body parts formed of high impact plastic material, which parts are substantially identical in configuration to each other and each of which forms a partial recess, a hinge permanently connecting each of said parts together along a common margin thereof permitting said parts to be moved from an open position in which a handgun may be placed therein and a closed position in which said parts mate together and form an interior space proportioned to receive such handgun therein, said parts, in the closed position, defining a forward facing opening proportioned to permit such gun barrel to extend therethrough and a downwardly facing opening proportioned to permit a portion of such handgrip to extend therethrough and, in said closed position, enclosing such gun breech, trigger and trigger guard, leaving exposed only a portion of the gun barrel and a portion of the handgrip extending respectively through said forward facing opening and said downwardly facing opening, said parts in said closed position having mutually interfitting and overlapping marginal edge portions for resisting ingress of a tool therebetween, said hinge along said common margin being substantially embedded within the plastic material of each of said parts, and a key operated lock extending between said parts at the portion thereof enclosing such trigger guard for retaining said parts in said closed position.

2. The safety gun shield of claim 1 further comprising a plurality of individual foam rubber pads positioned on the inside walls of said parts for engaging an adjacent surface of a handgun therein when said parts are in said closed position and for resisting relative movement of said guard with respect to such handgun.

3. The safety gun shield of claim 1 in which said plastic material is a polycarbonate of a thickness of about 2 millimeters.

4. A gun shield for enclosing certain portions of the operating mechanism of a handgun having a barrel, breech, trigger and trigger guard and hand grip, comprising a clamshell-like enclosure including a pair of opposed substantially identical halves, hinge means joining said halves together about a common pivot line for pivotal movement between an open position and a closed position, said halves together defining an internal cavity in said closed position proportioned to enclose at least said gun breech, trigger and trigger guard, said pivot line oriented substantially parallel to the barrel when such handgun is positioned within said shield, said shield halves, in said closed position, fully enclosing such breech and trigger guard and being formed with a forwardly facing opening through which a portion of such barrel may project and a downwardly facing opening through which a portion of such handgrip may project, said halves being formed with mating marginal edges in the closed position, said marginal edges of said halves defining a flanged overlap for resisting the direct entry of prying tools therebetween, and a lock joining said halves in the region of such gun trigger guard for retaining said halves in said closed position about such handgun.

5. The shield of claim 4 in which said hinge means has pairs of hinge wings one each embedded in each of said halves.

* * * * *